US005643022A

United States Patent [19]

Wagner

[11] Patent Number: 5,643,022

[45] Date of Patent: Jul. 1, 1997

[54] STEERING CYLINDER WITH ENGINE-CLEARANCE FEATURES AND METHOD FOR MAKING THE CYLINDER

[75] Inventor: Jerald G. Wagner, Venice, Fla.

[73] Assignee: IMO Industries, Inc., Sarasota, Fla.

[21] Appl. No.: 522,508

[22] Filed: Sep. 1, 1995

[51] Int. Cl.[6] ..... B63H 20/12

[52] U.S. Cl. ..... 440/61; 114/150

[58] Field of Search ..... 440/53, 61, 63, 440/59, 65, 500; 114/150, 144 R; 248/640–643

[56] References Cited

U.S. PATENT DOCUMENTS

| | | | |
|---|---|---|---|
| 2,787,235 | 4/1957 | Schroeder | 114/150 |
| 2,855,755 | 10/1958 | Auger | 60/54.5 |
| 4,482,330 | 11/1984 | Cook | 440/61 |
| 4,687,448 | 8/1987 | Peirce | 440/61 |
| 4,731,035 | 3/1988 | Wagner | 440/61 |
| 4,773,882 | 9/1988 | Rump | 440/61 |
| 4,836,812 | 6/1989 | Griffiths | 440/61 |
| 5,149,285 | 9/1992 | Kinoshita | 440/61 |
| 5,340,341 | 8/1994 | Yoshimura | 440/61 |
| 5,427,045 | 6/1995 | Fetchko | 114/150 |
| 5,542,864 | 8/1996 | Peebles | 440/61 |

*Primary Examiner*—Stephen Avila
*Attorney, Agent, or Firm*—Jansson & Shupe, Ltd.

[57] ABSTRACT

A hydraulic cylinder for steering a tiltable boat engine includes a cylinder housing with first and second housing ends. In the improvement, at least the first end includes a reduced-dimension relief portion preventing the cylinder first end from contacting the engine when the engine is tilted. A new method for making such a cylinder includes the steps of forming a cylinder housing having a mid-section and first and second housing ends and shaping a relief portion at the first end. The cylinder first end is thereby prevented from contacting the engine (and, particularly, the engine stern bracket) when the engine is tilted. The invention also involves unique manufacturing and assembly techniques.

17 Claims, 9 Drawing Sheets

STEERING CYLINDER WITH ENGINE-CLEARANCE FEATURES AND METHOD FOR MAKING THE CYLINDER

FIELD OF THE INVENTION

This invention relates generally to ships and boats, and, more particularly, to vessel steering.

BACKGROUND OF THE INVENTION

Water-going vessels are steered in any of a variety of ways. One way—commonly used on seagoing vessels and on larger pleasure craft—is to have one, two or more "screws" or propellers turned by shafts, the orientation(s) of which remain unchanged with respect to the vessel hull. Steering is by a separate rudder.

Another way commonly used with smaller pleasure craft is to pivot all or a part of the propulsion system so that the rotational axis of the propeller moves with respect to the vessel hull and its long axis. On so-called inboard-outboard drives, only a portion of the propeller drive train pivots. However, on boats driven by outboard engines, the entire engine (but for its stern mounting bracket and the like) are pivoted on the transom of the boat.

Smaller outboard engines are steered by an operator sitting at the rearmost seat and grasping the engine handle. Such handle not only pivots the engine about a generally vertical axis, it usually includes a twist-type throttle control. Thus, the operator controls vessel speed and direction with one hand.

But for larger outboard engines, hand steering in that manner is impractical. For one thing, the engine is simply too heavy to steer with one hand. And boats large enough to accept such an engine usually have steering and throttle controls at a forward seat location. The operator faces directly forward as when driving an automobile.

Larger outboard engines are often steered using some type of "force-multiplying" mechanism such as a steering wheel and control cable, the latter as made by Morse Controls and others. Or steering may be by hydraulic cylinder. In a common arrangement, the cylinder body is mounted in a fixed location and a cylinder rod is coupled to the engine tiller bar by a steering link. In another arrangement, the rods are at a fixed location and the cylinder body is coupled to the tiller bar for bar movement.

Apparatus for boat steering are shown in U.S. Pat. No. 2,787,235 (Schroeder); U.S. Pat. No. 4,773,882 (Rump); U.S. Pat. No. 4,836,812 (Griffiths); U.S. Pat. No. 5,340,341 (Yoshimura) and, no doubt, others. In the arrangement disclosed in the Griffiths patent, the center bracket on which the steering cylinder is rigidly mounted is, itself, rigidly attached to the steering arm of the primary engine.

The outer bracket to which the rods of the steering cylinder is attached is described as "stationary." A reason why such bracket may be so described is that pivoting the engine around its tilt tube (thereby raising the engine propeller) seemingly runs a high risk of badly damaging the outer bracket and/or the hydraulic cylinder. This is so since as the engine is so pivoted, the steering cylinder and related hardware are urged downward toward (and perhaps forcefully against) the boat transom.

The arrangements shown in the Schroeder and Yoshimura patents seemingly avoid the matter of possible cylinder damage during engine pivoting by locating the cylinder laterally to one side of the boat long axis. While this places the cylinder "out of the way," it complicates the mechanical linkages and results in a less-attractive installation which occupies more space than, in view of the invention, is necessary.

The assembly disclosed in the Rump patent uses a cylinder pivotably pinned to the tiller arm of an outboard engine. While such cylinder is directly in front of the engine, it is spaced well forward of such engine. Such assembly exhibits the same deficiency as the system of the Griffiths patent in that the cylinder is subject to damage when it is urged downward toward (and perhaps against) the boat transom.

The prior art, as represented by the above-noted patents, does not suggest a way to "closely-couple" a cylinder to an outboard engine and yet permit parts of such engine, e.g., the engine stern bracket, to "clear" the cylinder when the engine is tilted upward. And such prior art steering cylinders appear to be conventionally constructed and do not take advantage of the innovative features presented by the invention. An improved steering cylinder which addresses these disadvantages would be an important advance in the art.

OBJECTS OF THE INVENTION

It is an object of the invention to provide an improved hydraulic cylinder for steering outboard engines which overcomes some of the problems and shortcomings of the prior art.

Another object of the invention is to provide an improved steering cylinder which may be "closely coupled" to the outboard engine being steered.

Another object of the invention is to provide an improved steering cylinder which mounts directly forward of the engine being steered and yet provides clearance when such engine is tilted upward.

Yet another object of the invention is to provide an improved method for making a hydraulic steering cylinder.

Another object of the invention is to provide an improved method for making a steering cylinder wherein such method incorporates innovative manufacturing and assembly techniques.

How these and other objects are accomplished will become apparent from the following descriptions and from the drawings.

SUMMARY OF THE INVENTION

The invention involves a hydraulic cylinder for steering a tiltable boat engine. In one aspect, such cylinder has a cylinder housing, a housing long axis and first and second housing ends. In the improvement, at least the first end includes a relief portion preventing the engine from contacting the first end when the engine is tilted.

More specifically, the housing has a mid-section between the housing ends and such mid-section has a central cross-sectional area in a central plane which is generally normal to the long axis. The relief portion has a first cross-sectional area in a first plane generally normal to the long axis and the first cross-sectional area is less than the central cross-sectional area.

Considered another way, when the cylinder is used in combination with a boat having bow and a boat long axis, the mid-section has a central dimension measured generally parallel to the boat long axis, the relief portion has a first dimension measured generally parallel to the boat long axis and the first dimension is less than the central dimension. The cylinder also has a reference surface generally parallel to the housing long axis and the central dimension and the first dimension are measured from the reference surface and in a direction toward the boat bow.

In a highly preferred embodiment, the relief portion is a first relief portion and the second housing end includes a second relief portion. The reason it is desirable to have relief portions at both ends of the cylinder is that the stern bracket of each of many popular outboard engines extends generally parallel to and coextensive with the entire cylinder, not just one end of such cylinder. By shaping relief portions at both cylinder ends, interference between the cylinder and the stern bracket is avoided.

The second relief portion has a second cross-sectional area in a second plane generally normal to the long axis. The first and second cross-sectional areas are each less than the central cross-sectional area and, in a specific embodiment, the first and second cross-sectional areas are generally equal to one another. The second relief portion has a second dimension measured generally parallel to the boat long axis and the second dimension is less than the central dimension. In a specific embodiment, the second dimension and the first dimension are generally equal to one another.

Another aspect of the invention involves a method for making a hydraulic cylinder for steering an outboard boat engine. The method includes the steps of forming a cylinder housing having a mid-section and first and second housing ends and shaping a relief portion at the first end so that the engine (and, specifically, the engine stern bracket) is prevented from contacting the first end when the engine is tilted.

In a more specific aspect of the method, the forming step includes forming the mid-section to have a central cross-sectional area in a central plane generally normal to the long axis and the shaping step includes shaping the relief portion to have a first cross-sectional area in a first plane generally normal to the long axis. Shaping is in a manner such that the first cross-sectional area is less than the central cross-sectional area.

Preferably, the forming step also includes forming the mid-section to have a central dimension measured generally parallel to the boat long axis. The shaping step also includes shaping the relief portion to have a first dimension which is measured generally parallel to the boat long axis and which is less than the central dimension. The forming step further includes forming the cylinder to have a reference surface generally parallel to the housing long axis.

In a variation of the new method, the forming step also includes forming an elongate chamber in the housing, forming an elongate first fluid passage generally parallel to the chamber and machining a fluid flow path between the chamber and the first fluid passage. In a highly-preferred method, the machining step includes cutting material from the housing using a rotating-wheel cutter rather than the conventional drilling of a hole between the passage and chamber.

Another variation of the new method relates to cylinder assembly. The housing is formed to have a wall and an open end and the method also includes the steps of cutting an opening in the wall, providing an end plug having a longitudinally-formed wire catch (e.g., a hole drilled in the end of the end plug), placing the closure plug into the open end, attaching a retention wire through the opening to engage the wire catch and rotating the closure plug.

As will be apparent from the detailed description, rotating the plug draws the retention wire into a wire groove in the plug. The retention wire is also in registry with a wire groove in the cylinder wall and the wire prevents the plug and housing from separating from one another. In that regard, the wire acts like a retaining snap-ring but is easier and quicker to install and is more cost-effective.

The rotating-wheel cutter used for machining the flow path between the chamber and the first fluid passage is a first cutter while the rotating-wheel cutter used to cut an opening in the wall is a second cutter. Most preferably, both cutters are Woodruff cutters and have differing diameters.

Further details of the invention are set forth in the following detailed description and in the drawings.

DETAILED DESCRIPTION OF PREFERRED EMBODIMENTS

Before describing details of the new cylinder 10, it will be helpful to have an understanding of how such cylinder 10 is used to steer an outboard engine. Referring first to FIG. 1, the new outboard engine steering cylinder 10 is of the "double-ended" type, so named because a rod 13, 13*a* extends from each cylinder end.

Figure 21:
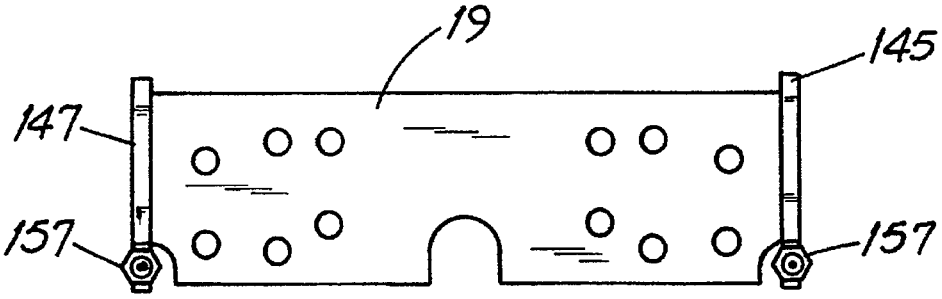
FIG. 21 is an elevation view of the mounting bracket used to secure the steering cylinder to the outboard engine.
Figure 22:
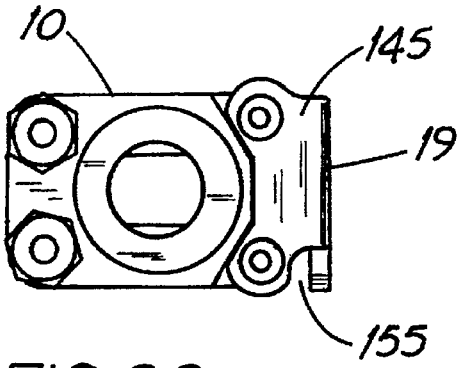
FIG. 22 is an end elevation view of the cylinder and a mounting bracket taken generally from the perspective of viewing axis VA9–10 of FIG. 1B.

The cylinder 10 includes a housing 11, the cylinder rods 13, 13*a*, bleed fittings 15 and hydraulic flow fittings 17. Housing 11, preferably made of extruded aluminum, is rigidly attached to the outboard engine 23 by a bracket 19 described below and shown in FIGS. 21 and 22. The cylinder rod 13*a* is attached to the engine tiller bar 25 by linkage 21 so that when the rod 13*a* is extended or retracted (moved right or left as shown in FIG. 1 and as represented by the arrows 26, 26*a*, respectively), the tiller bar 25 and engine 23 pivot for boat steering. (The tiller bar 25 is rigidly attached to the engine 23.)

Figure 2:
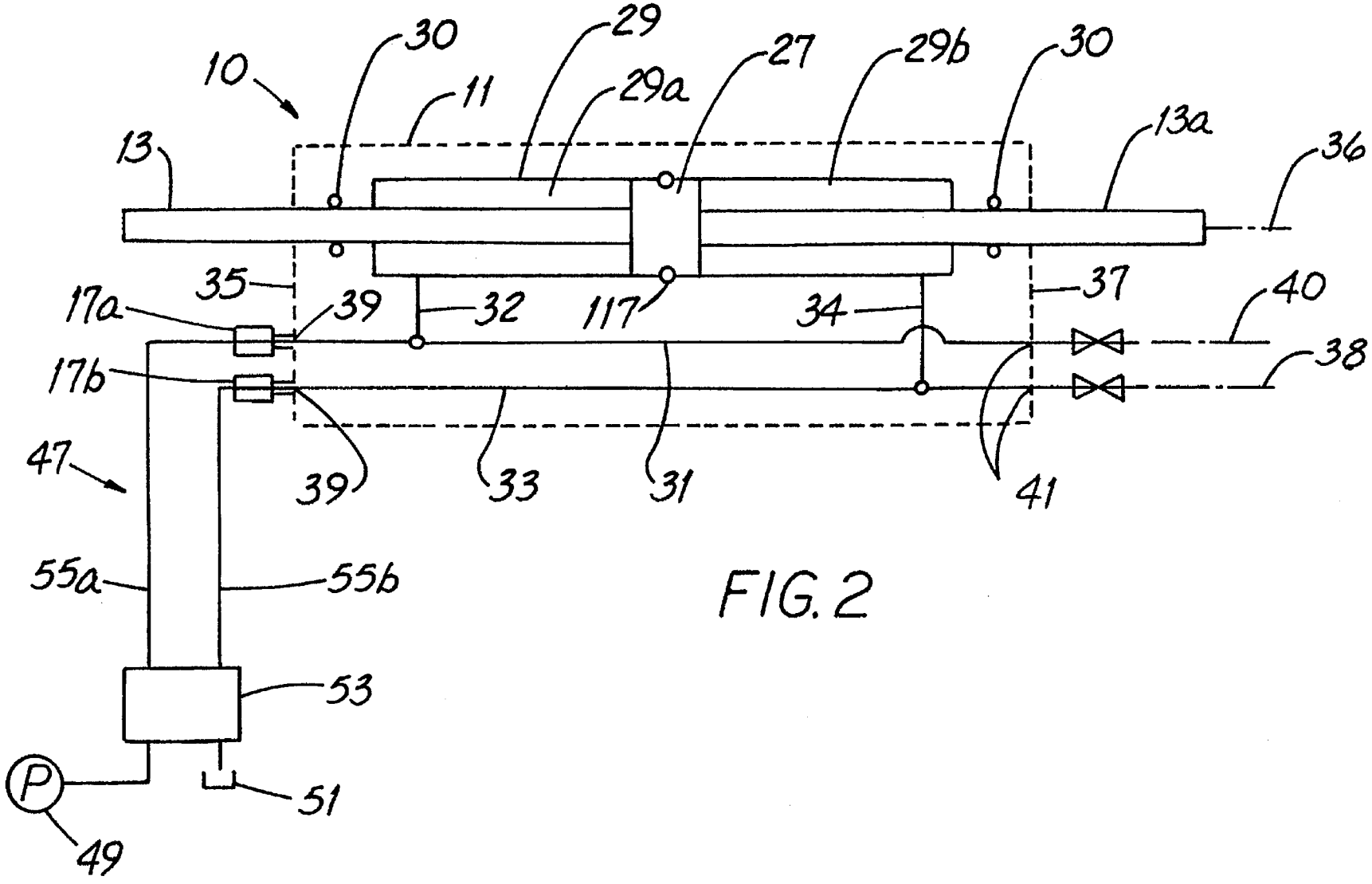
FIG. 2 is a representative cross-sectional view, like a circuit diagram, showing the internal arrangement of the improved steering cylinder and the related hydraulic steering system. The cylinder housing is represented in dashed outline.

Referring now to FIG. 2, the housing 11 includes an elongate, generally-cylindrical interior chamber 29, a piston 27 movable in chamber 29 and first and second fluid passages 31, 33, respectively, which are generally parallel to chamber 29. The long axis 38 or 40 of at least passage 31 or 33, respectively, is spaced from the long axis 36 of chamber 29. (As noted below, such axis 36 also constitutes the long axis of the housing 11.)

Figure 3:
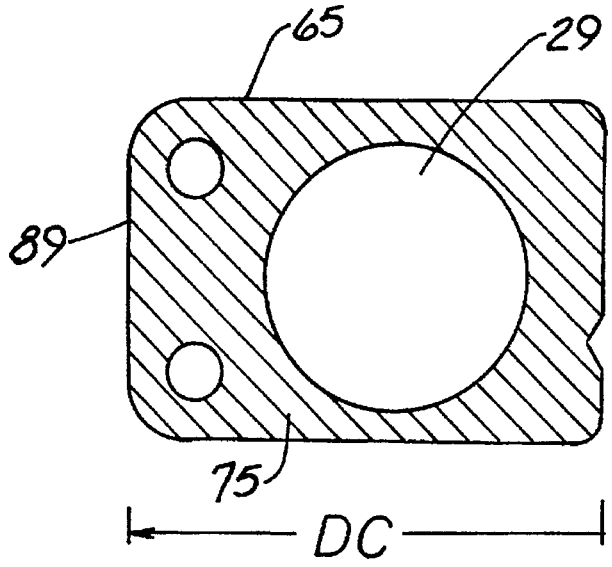
FIG. 3 is a cross-sectional view of the steering cylinder housing taken generally along the viewing plane 3—3 of FIGS. 4 or 5.

In the depicted embodiments, the long axes 38, 40 of passages 31 and 33, respectively are both spaced from the long axis 36 of chamber 29 and from one another. And the axes 36, 38, 40 are generally parallel to one another. FIG. 3 (a view taken at the mid-sections of the cylinder embodiments of FIGS. 4 or 5) illustrates the relationship of chamber 29 and passages 31 and 33 within housing 11.

A piston 27 divides chamber 29 into first and second chamber portions 29*a*, 29*b*, respectively. Chamber 29 is closed at each end by annular rod seals 30 through which cylinder rods 13, 13*a* move. Passage 31 is connected by fluid flow path 32 to the first portion 29*a* of the chamber 29. Similarly, passage 33 is connected by fluid flow path 34 to the second portion 29*b* of such chamber 29. Hydraulic fluid fills passages 31 and 33, fluid paths 32 and 34 and chamber 29 and the way in which such configuration is used to pivot the engine 23 and steer the boat on which such engine 23 is mounted is described below.

The housing 11 includes first and second end faces 35, 37, respectively, which are spaced from one another. In a highly preferred arrangement, each of passages 31 and 33 has a terminus 39 at the end face 35. Similarly, each of such passages 31 and 33 has a second terminus 41 at end face 37. It is to be appreciated that while it is not mandatory for each passage 31, 33 to have a terminus 39, 41 at each end face 35, 37, respectively, such arrangement is very advantageous for reasons relating to initial installation and system bleeding.

The boat steering system 47 includes a pump 49, a tank or reservoir 51 and a valving device 53 for alternately directing high pressure hydraulic fluid to fitting 17*a* or 17*b*. In practice, the device 53 may be embodied in and part of the boat steering wheel mechanism. But for the innovative cylinder 10 and its different aspects, systems like system 47 are in common use.

In operation, it is assumed that hydraulic line 55*a* is pressurized by manipulating the device 53. Pressurized fluid is directed to chamber portion 29*a* through flow path 32 and the piston 27 and rod 13*a* move to the right, i.e., in the direction of the arrow 26 in FIG. 1. As a consequence and as represented by the arrow 57, the engine pivots counterclockwise (viewed "top down") about substantially-vertical pivot axis 59. This causes the vessel to steer rightward. Of course, pressurizing line 55*b* has the result of steering the vessel leftward.

Other details of the new cylinder 10 will now be described. Referring particularly to FIGS. 3 through 10, the housing mid-section 65 is between first and second housing ends 67 and 69, respectively. At least the first end 67 includes a "cutaway" relief portion 71 preventing the cylinder 10 (and particularly its first end 67) from contacting the engine 23 and, particularly, the engine stern bracket 73 when the engine 23 is moved between its normal vertical position shown in FIG. 9 and its tilted position shown in FIG. 10. (It is to be noted that since the cylinder 10 is affixed to the engine 23, the cylinder 10 pivots downwardly from the position shown in FIG. 9 to that shown in FIG. 10.)

Figure 8:
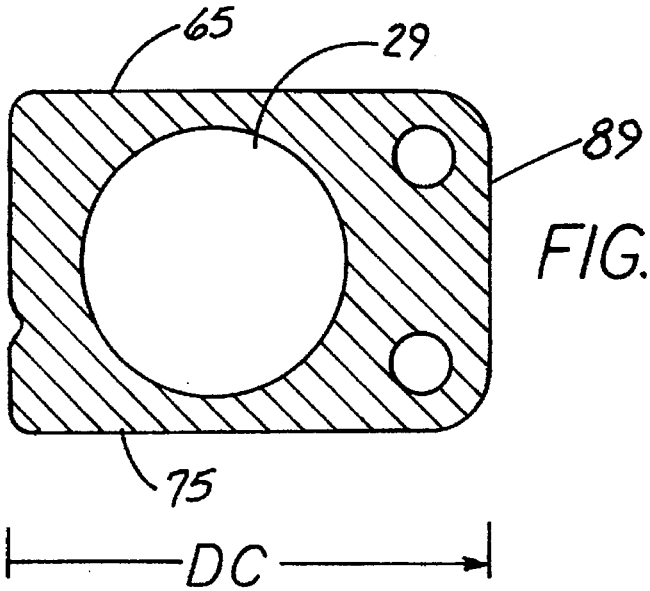
FIG. 8 is a cross-sectional view of the steering cylinder housing taken generally along the viewing plane 8—8 of FIG. 4.
Figure 9:
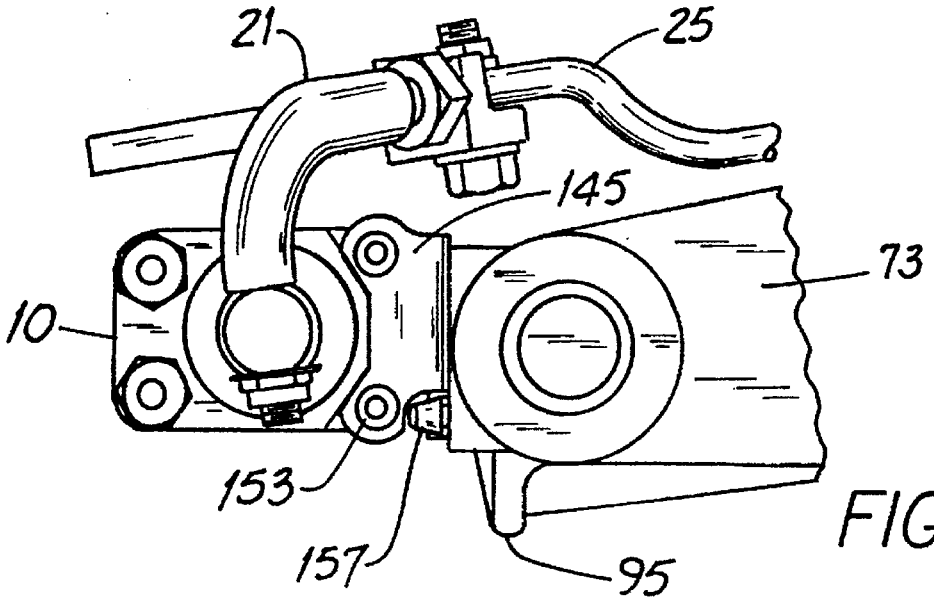
FIG. 9 is a view taken generally along the viewing axis VA9–10 of FIG. 1 and showing the relative position of the cylinder to the engine stern bracket when the engine is in its normal vessel-propelling position. Parts are broken away.
Figure 10:
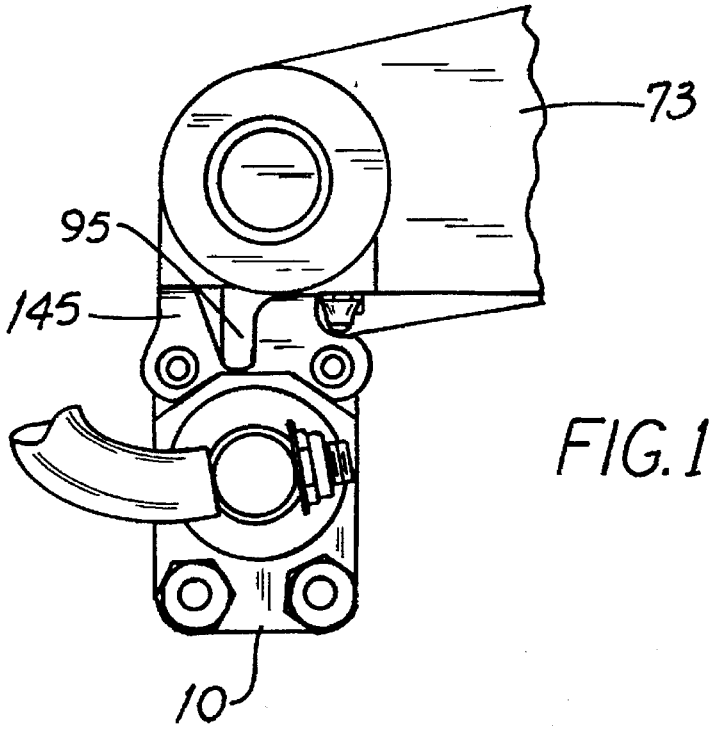
FIG. 10 is a view taken generally along the viewing axis VA9–10 of FIG. 1 and showing the relative position of the cylinder to the engine stern bracket when the engine is tilted toward horizontal. Parts are broken away.

As shown in FIGS. 3 and 8, the cylinder mid-section 65 has a central cross-sectional area 75 (marked by parallel lines in FIGS. 3 and 8) in a central plane 77 (shown in FIG. 4) which is generally normal to the long axis 36. As marked by cross-hatch lines in FIG. 7, the relief portion 71 has a first area 79 in a first plane generally normal to the long axis 36 and the first area 79 is less than the central cross-sectional area 75.

Figure 1A:
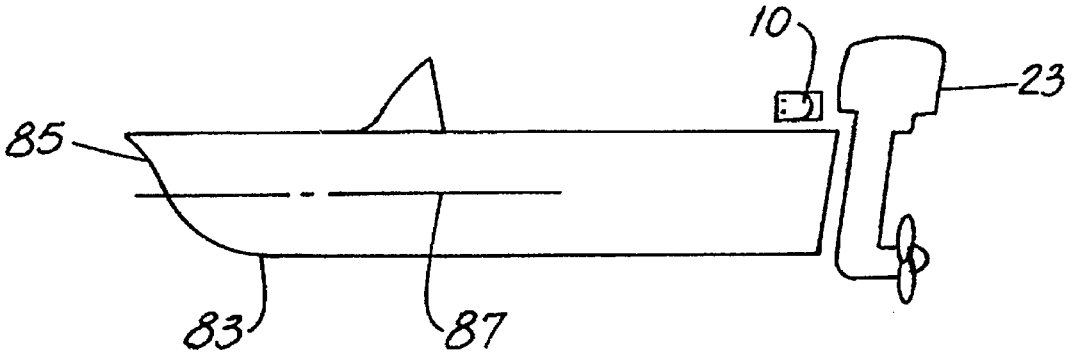
FIG. 1A is a representative side elevation view showing a boat with its outboard engine and steering cylinder.

Referring also to FIG. 1A, when the cylinder 10 is used in combination with a boat 83 having a bow 85 and a boat long axis 87, the mid-section 65 has a central dimension DC measured generally parallel to the boat long axis 87, the relief portion 71 has a first dimension D1 measured generally parallel to the boat long axis 87 and the first dimension D1 is less than the central dimension DC. The cylinder 10 also has a reference surface 89 generally parallel to the housing long axis 36 and the central dimension DC and the first dimension D1 are measured from the reference surface 89 and in a direction away from the boat bow 85.

In a highly preferred embodiment, the relief portion 71 is a first relief portion 71 and the second housing end 69 includes a second relief portion 91. The reason it is desirable to have relief portions 71, 91 at respective ends 67, 69 of the cylinder 10 is that the projection 95 of the stern bracket 73 of each of many popular outboard engines 23 is at both ends 67, 69 of the cylinder 10, not just at one end 67 or 69. By shaping cutaway relief portions 71, 91 at respective cylinder ends 67, 69, interference between the cylinder 10 and the stern bracket 73 and its projection 95 is avoided.

Figure 6:
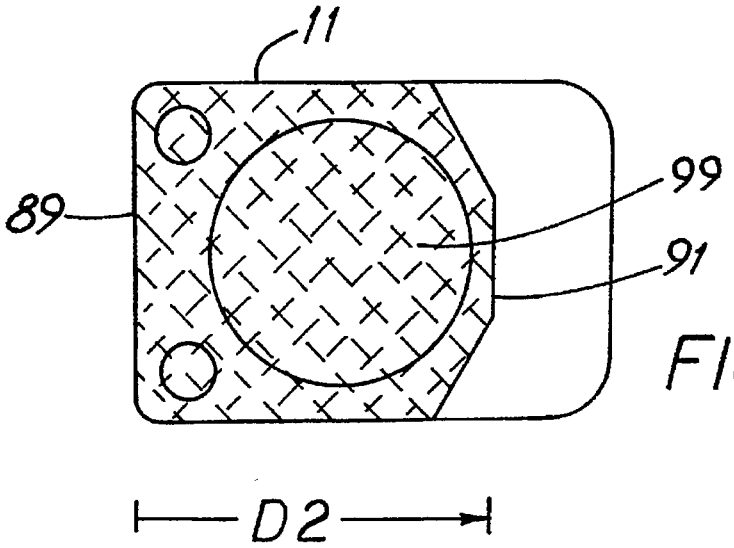
FIG. 6 is a section view of the housing taken generally along the viewing plane 6—6 of FIG. 4.
Figure 7:
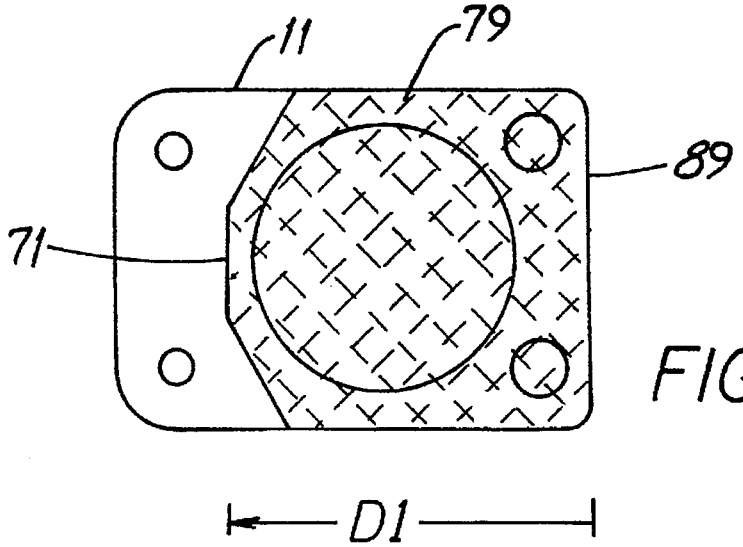
FIG. 7 is a section view of the housing taken generally along the viewing plane 7—7 of FIG. 4.
Figure 4:
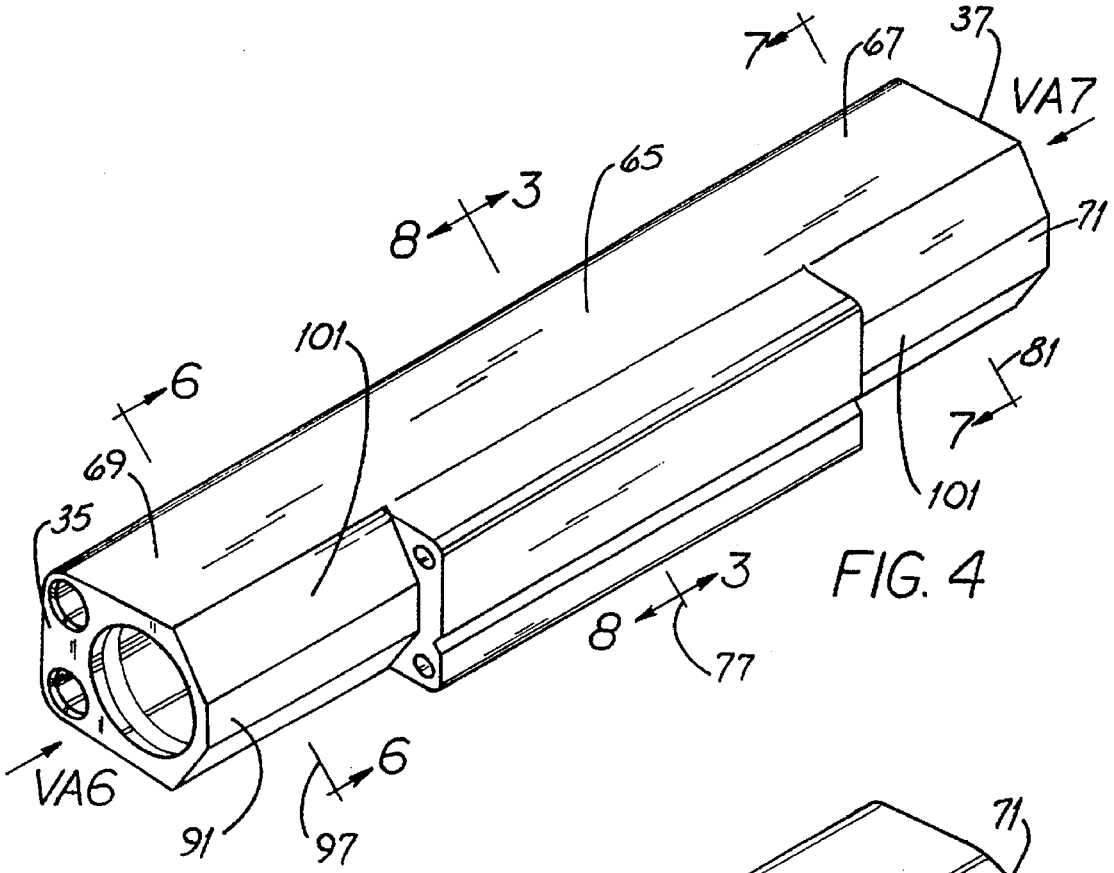
FIG. 4 is a perspective view of one embodiment of the cylinder housing.
Figure 5:
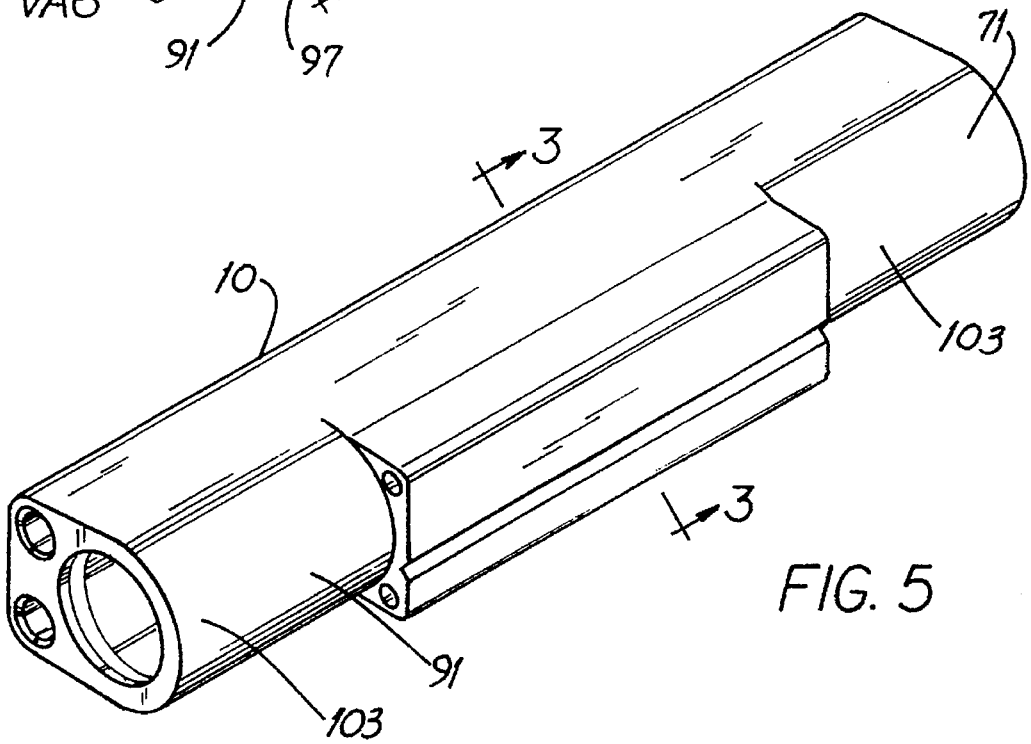
FIG. 5 is a perspective view of another embodiment of the cylinder housing.
Figure 17:
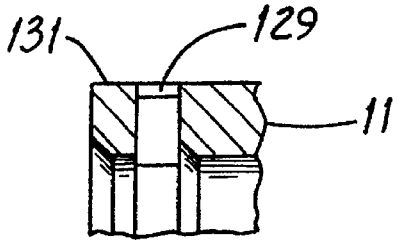
FIG. 17 is an enlarged section view of a portion of the housing end shown in FIG. 11. Parts are broken away.
Figure 12:
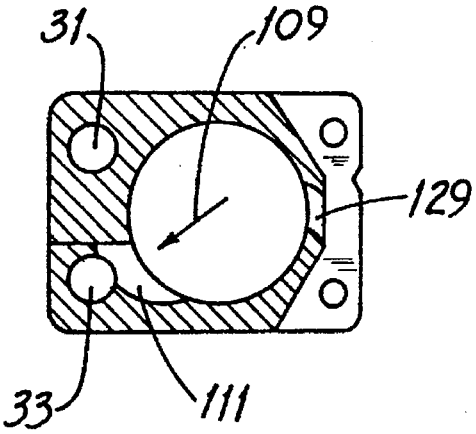
FIG. 12 is a section view of the housing of FIG. 11 taken generally along the viewing line 12—12 thereof.

Referring also to FIGS. 4, 6 and 8, the second relief portion 91 has a second area 99 (marked by cross-hatch lines in FIG. 6) in a second plane 97 generally normal to the long axis 36. The first and second areas 79, 99 are each less than the central cross-sectional area 75 and, in a specific embodiment, the first and second areas 79, 99 are generally equal to one another.

The second relief portion 91 has a second dimension D2 measured generally parallel to the boat long axis 87 and the second dimension D2 is less than the central dimension DC. In a specific embodiment, the second dimension D2 and the first dimension D1 are generally equal to one another.

(The central plane 77 noted above may be any plane normal to the long axis 36 and sectioning the mid-section 65. And the first area 79 and the second area 99 may be those seen along the viewing axes VA7 and VA6, respectively, or may be the areas 79, 99 in respective planes, e.g., planes 81 and 97, normal to the long axis 36 and sectioning a relief portion 71 or 91.)

Another aspect of the invention involves a method for making a hydraulic cylinder 10 for steering an outboard boat engine 23. The method includes the steps of forming a cylinder housing 11 having a mid-section 65 and first and second housing ends 67, 69 and configuring the relief portion 71 at the first end 67 so that the cylinder 10 is prevented from contacting the engine 23 (and, specifically, the engine stern bracket 73) when the engine 23 is tilted.

In the cylinder of FIG. 4, the "flats" may be formed by machining. In the cylinder 10 of FIG. 5, the curved profile 103 of the relief portions 71, 91 may be formed by a profiling machine. And either may be formed by casting if and when the housing 11 is cast.

In a more specific aspect of the method, the forming step includes forming the mid-section 65 to have a central cross-sectional area 75 in a central plane 77 generally normal to the long axis 36 and the shaping step includes shaping the relief portion 71 to have a first cross-sectional area 79 in a first plane 81 generally normal to the long axis 36. Shaping is in a manner such that the first cross-sectional area 79 is less than the central cross-sectional area 75.

Preferably, the forming step also includes forming the mid-section 65 to have a central dimension DC measured generally parallel to the boat long axis 87. The shaping step also includes shaping the relief portion 71 to have a first dimension D1 which is measured generally parallel to the boat long axis 87 and which is less than the central dimension DC. The forming step further includes forming the cylinder 10 to have a reference surface 89 generally parallel to the housing long axis 36.

The intermediate product from which the housing 11 is made is most preferably configured by extruding an elongate "slug" of aluminum through a die. After extrusion, the intermediate product will have a cross-sectional shape like that shown in FIGS. 3 and 8 and will have the chamber 29 and the passages 31, 33 formed in it. Machining the flow paths 32, 34 as described below may be before or after the relief portions 71, 91 of the ends 67 and 69, respectively, are shaped.

Figure 15:
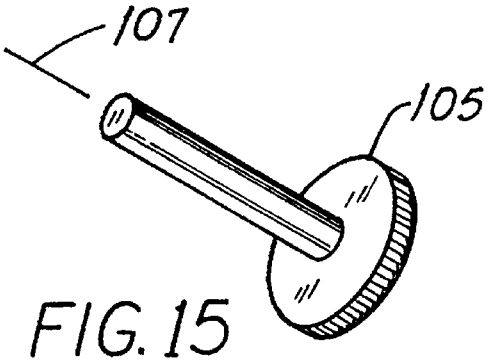
FIG. 15 is a perspective view of a rotary cutter, e.g., a Woodruff key cutter.

FIGS. 11 through 15, show how the flow paths 32, 34 identified in FIG. 2 are machined into the housing 11. A rotating-wheel cutter 105 of the type shown in FIG. 15 is inserted into one end 69 of the housing 11 with the cutter axis of rotation 107 generally parallel to the axis 36. While maintaining axis parallelism, the cutter 105 is urged in the direction of the arrow 109 until such cutter 105 contacts and cuts material from the housing 11. The cutter 105 is advanced in the direction of the arrow 109 until the arc-shaped area 111 cut by it intersects with a passage such as passage 33. The arc-shaped area 111 so cut constitutes a flow path such as path 34.

After cutting one flow path, e.g., path 34 as described above, the cylinder 10 is turned end for end, the cutter 105 is inserted into the other end 67 of the housing 11 and another arc-shaped area 113 is cut. In a highly-preferred method, the cutter 105 is a Woodruff key cutter and has a diameter somewhat less than the diameter of the chamber 29.

Figure 11:
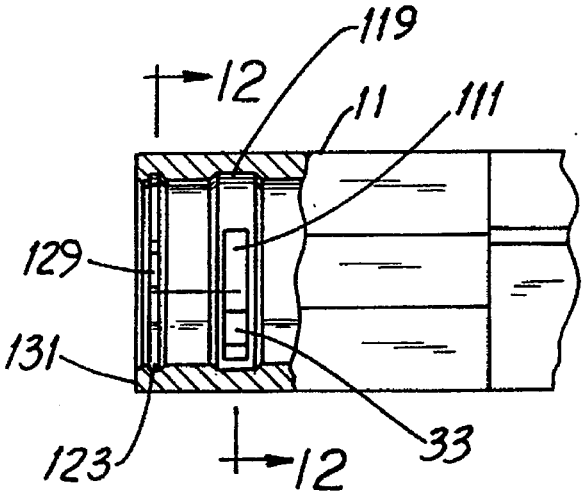
FIG. 11 is an elevation view of one end of the housing of FIG. 4. Parts are broken away and other parts are shown in section.
Figure 13:
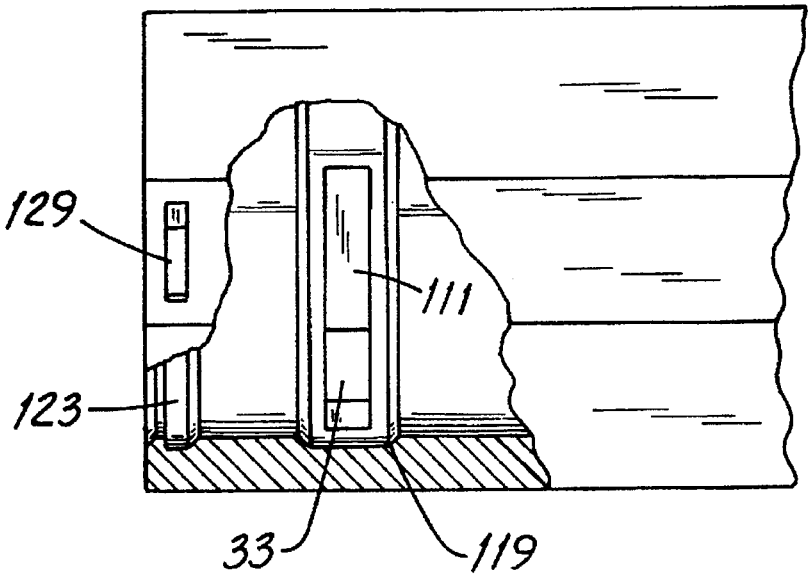
FIG. 13 is an enlarged view generally like that of FIG. 11.
Figure 18:
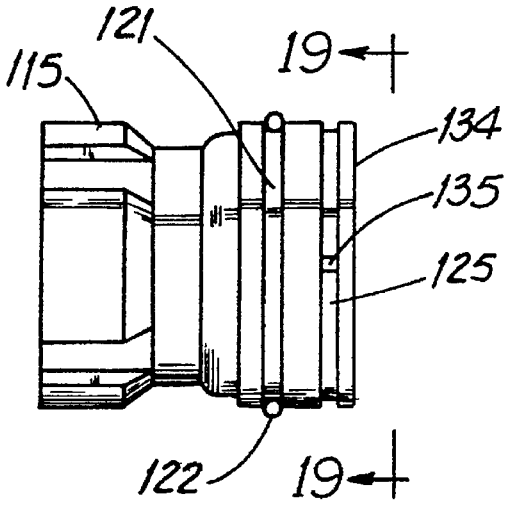
FIG. 18 is a side elevation view of a cylinder housing end closure plug.
Figure 19:
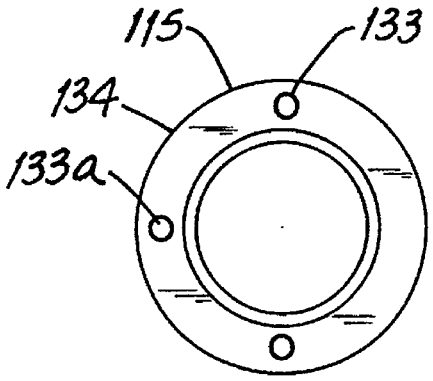
FIG. 19 is an end elevation view of the plug of FIG. 18 taken generally along the viewing plane 19—19 thereof.

Referring particularly to FIGS. 11 and 13, for reasons relating to insertion of the cylinder piston 27 and an O-ring seal 117 thereon, it is preferred to machine an annular chamfer-edged undercut 119 on the housing wall 131 before using the cutter 105. The diameter of the undercut 119 is slightly greater than the diameter of the expanded O-ring 117 and helps prevent such O-ring 117 from being cut or pulled out of its groove as the piston 27 is being inserted into the housing 11.

Referring next to FIGS. 11 through 19 another variation of the new method relates to cylinder assembly. An annular retention groove 123 is cut in the housing wall 131 adjacent to the open end 69. The end closure plug 115 has a groove 121 for an O-ring seal 122. An innovative feature of the cylinder 10 involves the end plug 115. The longitudinal hole **133*a* is drilled to a depth sufficient to "break through" the rim 134 into the wire retention groove 125, thus forming the wire catch 135**.

Figure 16:
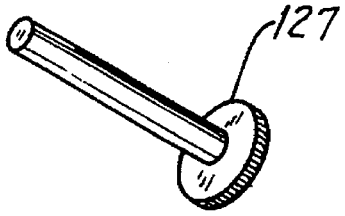
FIG. 16 is a perspective view of another rotary cutter, e.g., a Woodruff key cutter.
Figure 14:
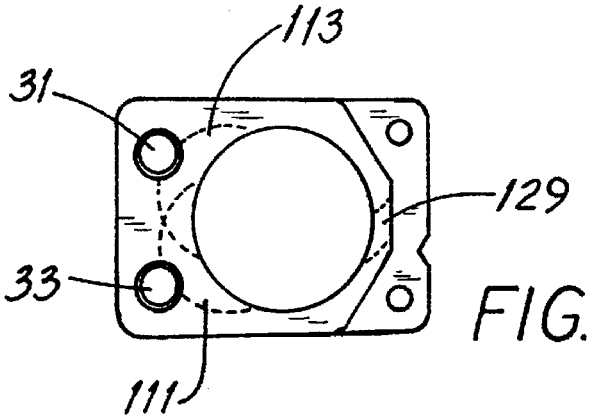
FIG. 14 is an end view of the housing of FIG. 4 showing, in dashed outline, flow paths between the cylinder chamber and respective elongate flow passages.

The retention groove 125 on the plug 115 and the groove 123 on the wall 131 are cooperatively located so that such grooves 123, 125 are in registry when the plug 115 is properly positioned axially in the housing 11. By using another cutter 127, e.g., a smaller-diameter Woodruff key cutter as shown in FIG. 16, an opening 129 is cut through such wall 131 at a location to intersect the groove 123. The closure plug 115 is then placed into the open end 69 and rotated (by engaging the holes 133 with a spanner wrench) until the wire catch 135 in the plug groove 125 is in registry with the opening 129.

Figure 20:
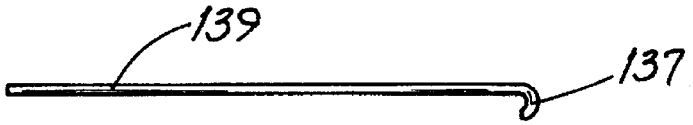
FIG. 20 is a side elevation view of a retention wire used to secure the plug of FIGS. 18 and 19 and the housing of FIGS. 4 or 5 together.

Referring also to FIG. 20, the hook end 137 of a retention wire 139 (the length of which is slightly less than the circumferential lengths of the grooves 123, 125) is inserted through the opening 129 to engage the catch 135. The closure plug 115 is then rotated with a spanner wrench. As such plug 115 rotates, the wire 139 is drawn into the cylinder 10 and fits into both grooves 123, 125. So placed, the wire 139 locks the plug 115 and the housing 11 together somewhat like a snap ring.

FIGS. 9, 10, 21, 22 and 23 show details of the mounting bracket 19 used to mount the new cylinder 10 to the engine 23. The forces imposed on the bracket 19 by the cylinder 10 (represented by the arrows 141, 143 in FIG. 23) are left/right as viewed in FIG. 2 and generally left/right as viewed in FIGS. 1 and 23.

A highly preferred bracket 19 has end members 145, 147 attached to the cylinder 10 at the mounting faces 149, 151, respectively. The members 145, 147 and the faces 149, 151 are generally normal to the direction of imposed forces. In this way, the forces are imposed across the relatively-wide areas of the members 145, 147 and faces 149, 151. There are no (or substantially no) shear forces imposed upon the bolts 153 used to secure the bracket 19 to the cylinder 10. It is also to be noted in FIGS. 9, 10, 22 and 23 that the members 145, 147 are shaped in such a way that they contact respective relief portions 91, 71 for added cylinder mounted stability. A preferred bracket 19 has cutout corners 155 to accommodate "Zerk" grease fittings 157.

Figure 23:
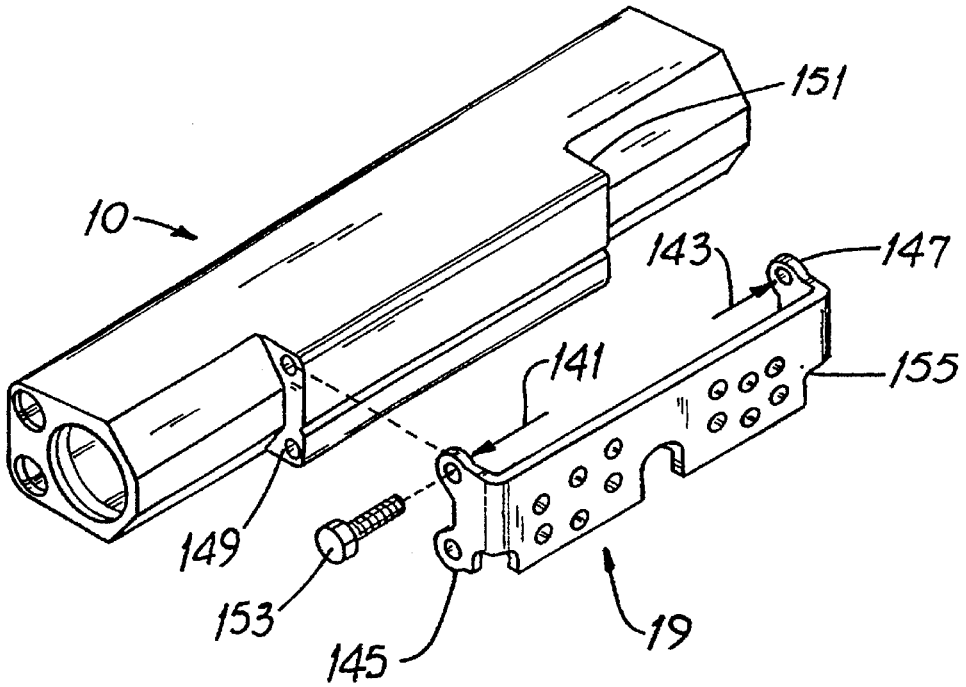
FIG. 23 is an exploded perspective view of a cylinder housing and its associated mounting bracket.
Figure 1B:
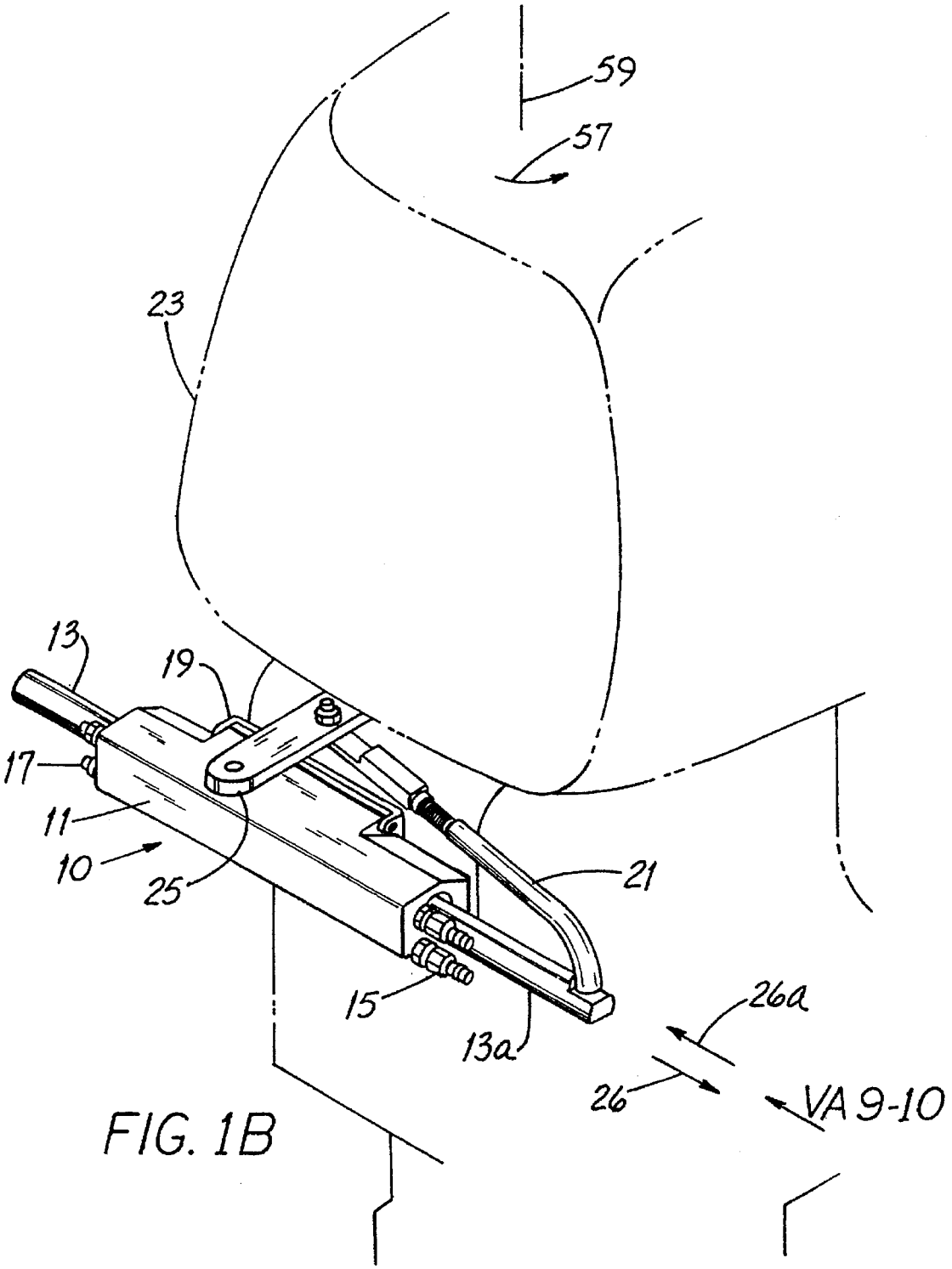
FIG. 1B is a close-up perspective view of the improved outboard engine steering cylinder shown in conjunction with an outboard engine represented in dashed outline.

From an inspection of FIGS. 1B or 23, it is apparent that the new cylinder 10 is symmetrical and invertible. That is, such cylinder 10 can be mounted so that the rod **13*a* and linkage 21 extend leftward rather than rightward as viewed in FIG. 1B**.

While the principles of the invention have been shown and described in connection with only a few specific embodiments, it is to be understood clearly that such embodiments are exemplary and not limiting.

What is claimed:

1. In combination, a tiltable outboard boat engine and a hydraulic cylinder coupled to the engine for steering, the cylinder including a cylinder housing with first and second housing ends, the improvement wherein:

the cylinder is rigidly mounted on the engine;

the cylinder includes a mid-section having a cross-sectional area;

the cylinder includes a reduced-dimension relief portion extending from the mid-section to the first housing end, the relief portion having a maximum cross-sectional area that is less than the cross-sectional area of the mid-section, thereby preventing the engine from contacting the cylinder first end when the engine is tilted.

2. The combination of claim 1 wherein the engine is mounted on a boat having a boat long axis and wherein:

the mid-section has a central dimension measured generally parallel to the boat long axis;

the relief portion has a first dimension measured generally parallel to the boat long axis; and the first dimension is less than the central dimension.

3. The combination of claim 2 wherein:

the cylinder has a reference surface generally parallel to the cylinder long axis; and the central dimension and the first dimension are measured from the reference surface and in a direction away from the boat bow.

4. The combination of claim 1 wherein the relief portion is a first relief portion, the second housing end includes a second relief portion, and wherein:

the cylinder includes a second reduced-dimension relief portion extending from the mid-section to the second housing end, the second relief portion having a maximum cross-sectional area that is less than the cross-sectional area of the mid-section, thereby preventing the engine from contacting either cylinder end when the engine is tilted.

5. The combination of claim 4 wherein the cross-sectional areas of the relief portions are generally equal to one another.

6. A method for making a hydraulic cylinder for steering an outboard boat engine and including the steps of:

forming a one-piece cylinder housing made of metal and having a mid-section and first and second housing ends integral with the mid-section;

and wherein the forming step includes:

shaping a relief portion at the first end, thereby preventing the engine from contacting the first end when the engine is tilted with respect to the cylinder.

7. The method of claim 6 wherein the housing includes a housing long axis and the forming step includes:

forming the mid-section to have a central cross-sectional area in a central plane generally normal to the long axis; and the shaping step includes:

configuring the relief portion to have a first area in a first plane generally normal to the long axis, such first area being less than the central cross-sectional area.

8. The method of claim 7 wherein the cylinder is made for use with a boat having a bow and a boat long axis, the step of forming the mid-section to have a central cross-sectional area in a central plane generally normal to the long axis includes forming the central cross-sectional area to have a central dimension measured generally parallel to the boat long axis and the shaping step also includes:

configuring the relief portion to have a first dimension measured generally parallel to the boat long axis, such first dimension being less than the central dimension.

9. The method of claim 8 wherein the cylinder mid-section has a reference surface generally parallel to the housing long axis;

the first end has a first-end surface coplanar with the reference surface; and the central dimension and the first dimension are measured from the reference surface and from the first-end surface, respectively, and in a direction away from the boat bow.

10. The method of claim 6 wherein the forming step also includes forming an elongate chamber in the housing and forming an elongate first fluid passage generally parallel to the chamber and the method also includes the step of:

machining a fluid flow path between the chamber and the first fluid passage.

11. The method of claim 10 wherein the machining step includes cutting material from the housing using a rotating-wheel cutter.

12. The method of claim 4 wherein the housing is formed to have a wall, one of the housing ends is an open end and the method also includes the steps of:

forming an opening in the wall;

providing an end plug having a longitudinally-formed wire catch;

placing the closure plug into the open end;

attaching a retention wire through the opening to engage the wire catch in the closure plug; and rotating the closure plug.

13. The method of claim 11 wherein (a) the rotating-wheel cutter is a first cutter, (b) the housing is formed to have a wall, one of the housing ends is an open end, and the method also includes the steps of:

cutting an opening in the wall;

placing a closure plug into the open end;

attaching a retention wire through the opening to the closure plug; and rotating the closure plug, and wherein the step of cutting an opening in the wall is by using a second rotating-wheel cutter.

14. In a hydraulic cylinder for steering a tiltable boat engine and including a cylinder housing with first and second housing ends, the improvement wherein:

the first end includes a reduced-dimension first relief portion preventing the engine from contacting the cylinder first end when the engine is tilted;

the second housing end includes a second relief portion;

the housing has a mid-section between the housing ends;

the mid-section has a central cross-sectional area in a central plane generally normal to the long axis;

the first relief portion has a first area in a first plane generally normal to the long axis;

the second relief portion has a second area in a second plane generally normal to the long axis;

the first and second areas are generally equal to one another and are each less than the central cross-sectional area; and the cylinder is substantially symmetrical about a plane midway between the housing ends.

15. A method for making a hydraulic cylinder for steering an outboard boat engine and including the steps of:

forming a cylinder housing having a mid-section and first and second housing ends;

shaping a relief portion at the first end so that the engine is prevented from contacting the cylinder first end when the engine is tilted;

and wherein:

one of the ends is an open end;

the housing is formed to have a wall, and the method also includes the steps of:

forming an opening in the wall;

providing an end plug having a longitudinally-formed wire catch;

placing the closure plug into the open end;

attaching a retention wire through the opening to engage the wire catch in the closure plug; and rotating the closure plug.

16. A method for making a hydraulic cylinder for steering an outboard boat engine and including the steps of:

forming a cylinder housing having a mid-section, first and second housing ends, an elongate chamber in the housing, and an elongate first fluid passage generally parallel to the chamber;

shaping a relief portion at the first end;

machining a fluid flow path between the chamber and the first fluid passage by cutting material from the housing using a rotating-wheel cutter.

17. The method of claim 16 wherein (a) the rotating-wheel cutter is a first cutter, (b) the housing is formed to have a wall and one of the ends open, and the method also includes the steps of:

cutting an opening in the wall by using a second rotating-wheel cutter;

placing a closure plug into the open end;

attaching a retention wire through the opening to the closure plug; and rotating the closure plug.

* * * * *